US005414876A

United States Patent [19]

Pan

[11] Patent Number: 5,414,876

[45] Date of Patent: May 16, 1995

[54] TOILET ASSEMBLY HAVING A HYDRAULICALLY RISING SEAT

[76] Inventor: Chien-Pang Pan, 19, Lane 891, Chien-Shou Rd., Taihsi, Taoyuan, Taiwan, Prov. of China

[21] Appl. No.: 232,694

[22] Filed: Apr. 25, 1994

[51] Int. Cl.[6] ..... A47K 13/10

[52] U.S. Cl. ..... 4/246.1; 4/241; 4/246.2

[58] Field of Search ..... 4/241, 246.1, 246.2, 4/246.3, 236

[56] References Cited

U.S. PATENT DOCUMENTS

| | | | |
|---|---|---|---|
| 3,301,121 | 1/1967 | Newcomer | 4/236 |
| 4,367,567 | 1/1983 | Sendoykas | 4/236 |
| 4,910,810 | 3/1990 | Solomon | 4/246.1 |
| 5,020,165 | 6/1991 | Huang | 4/246.2 |
| 5,138,724 | 8/1992 | Chien et al. | 4/246.2 |
| 5,291,618 | 3/1994 | Chiang | 4/241 |

FOREIGN PATENT DOCUMENTS

| | | | |
|---|---|---|---|
| 9002115 | 4/1992 | Netherlands | 4/241 |

*Primary Examiner*—Henry J. Recla
*Assistant Examiner*—Charles R. Eloshway
*Attorney, Agent, or Firm*—Ladas & Parry

[57] ABSTRACT

In a toilet seat and bowl assembly in which the seat rises hydraulically, a toilet bowl has an open-topped seat-receiving portion at one end, an inlet for flushing water at an opposite end and above the seat-receiving portion, a positioning base having a transverse through opening, and a passage for the flushing water from the inlet into the toilet bowl under the seat-receiving portion for flushing the flushing water through the opening, the passage having an upwardly facing, curved bottom surface. A toilet seat apparatus has a toilet seat at one end and a cup connected to the seat by a handle at an opposite end. The toilet seat apparatus is pivoted on the toilet bowl between the seat-receiving portion and the inlet with the seat-receiving on the toilet seat portion and the cup in the passage at a predetermined spacing from the bottom surface that remains substantially constant as the toilet seat apparatus pivots, whereby flushing water from the inlet raises the toilet seat from the seat-receiving portion of the toilet bowl.

2 Claims, 4 Drawing Sheets

TOILET ASSEMBLY HAVING A HYDRAULICALLY RISING SEAT

The present invention relates to a toilet assembly having an automatically and hydraulically rising seat, and particularly relates to a toilet assembly of which a seat can be automatically raised by weight and flow of flushing water during flushing of the toilet.

BACKGROUND OF THE INVENTION

Generally, a user of a toilet does not habitually raise a toilet seat after the use of the toilet seat, and thus the toilet seat tends to be polluted or fouled by a next male user when he urinates into the toilet. There are many known apparatuses or devices made in the art to solve such a problem by providing an auto-rising toilet seat.

Generally, conventional apparatuses or devices for automatically raising a toilet seat can be classified into the following categories;

1. Spring type: an apparatus of such a type mainly makes use of resilience of springs to raise a toilet seat when a user left away from the toilet seat. For example, ROC Patent Application No. 76208424 (Publication No. 104742) is related to an apparatus for automatically raising a toilet seat of such a spring type. However, the operation of an apparatus of such a spring type very likely gets worse due to the deterioration of resilience or fatigue of the springs used therein. Besides, it is inconvenient, uncomfortable and dangerous to a user, especially to an old person, child or invalid user, because the user has to press the seat before he/she sits on the seat or until he/she left away the seat in preventing the toilet seat from moving with the hip of the user.
2. Lifting weight type: an apparatus for automatically lifting a toilet seat of such a type mainly provides a lifting weight around pivot shafts in association with connecting rods and wires to create a rotational torque against the torque created by the weight of the seat, so as to complete the purpose for automatically lifting the toilet seat when a user left away from the seat. For example, ROC Patent Application No. 75212373 (Publication No. 96211) disclosed a delayed auto-rising toilet seat of such a lifting weight type. However, since the use of such a type need an additional space to allow the rotation of the lifting weight which extends from the seat, it is bulky and inconvenient to installation. Besides, when a user is leaving away from the toilet seat of such a type, the toilet seat moves upwardly together with the hip of the user, and cause an uncomfortable feeling to the user. Especially, it is dangerous to an old person, children or an invalid users.

In conclusion, various type of conventional toilet seat to be automatically lifted bears many disadvantages, e.g., the seat failing to be maintained in a horizontal position before the user already left away the seat and causing a trouble to the user.

SUMMARY OF THE INVENTION

The primary object of the present invention is to provide a toilet assembly having a hydraulically rising seat which can be automatically raised by weight and flow of flushing water during flushing. The toilet assembly comprises a toilet bowl, a seat, an assembling pad and a scoop. The toilet bowl includes a flushing inlet, a flushing water passage and a positioning base having a through opening. The seat mainly is in ring shape and is pivotally connected to the toilet bowl by the assembling pad. The scoop includes a scoop handle and a cup, in which the handle extends laterally from the cup and is attached onto one lower end of the seat to form as a torque arm, and is adapted to extend to the flushing water passage of the toilet bowl through the through opening of the positioning base. When the toilet seat is in a horizontal position, the cup of the scoop is immediately below the flushing inlet. Whereby water downwardly flushing from the flushing inlet, the scoop can be moved and creates a torque to raise the toilet seat to a vertical position.

These and other objects, advantages and features of the present invention will be more fully understood and appreciated by reference to the written specification.

DETAILED DESCRIPTION OF THE INVENTION

Figure 1:
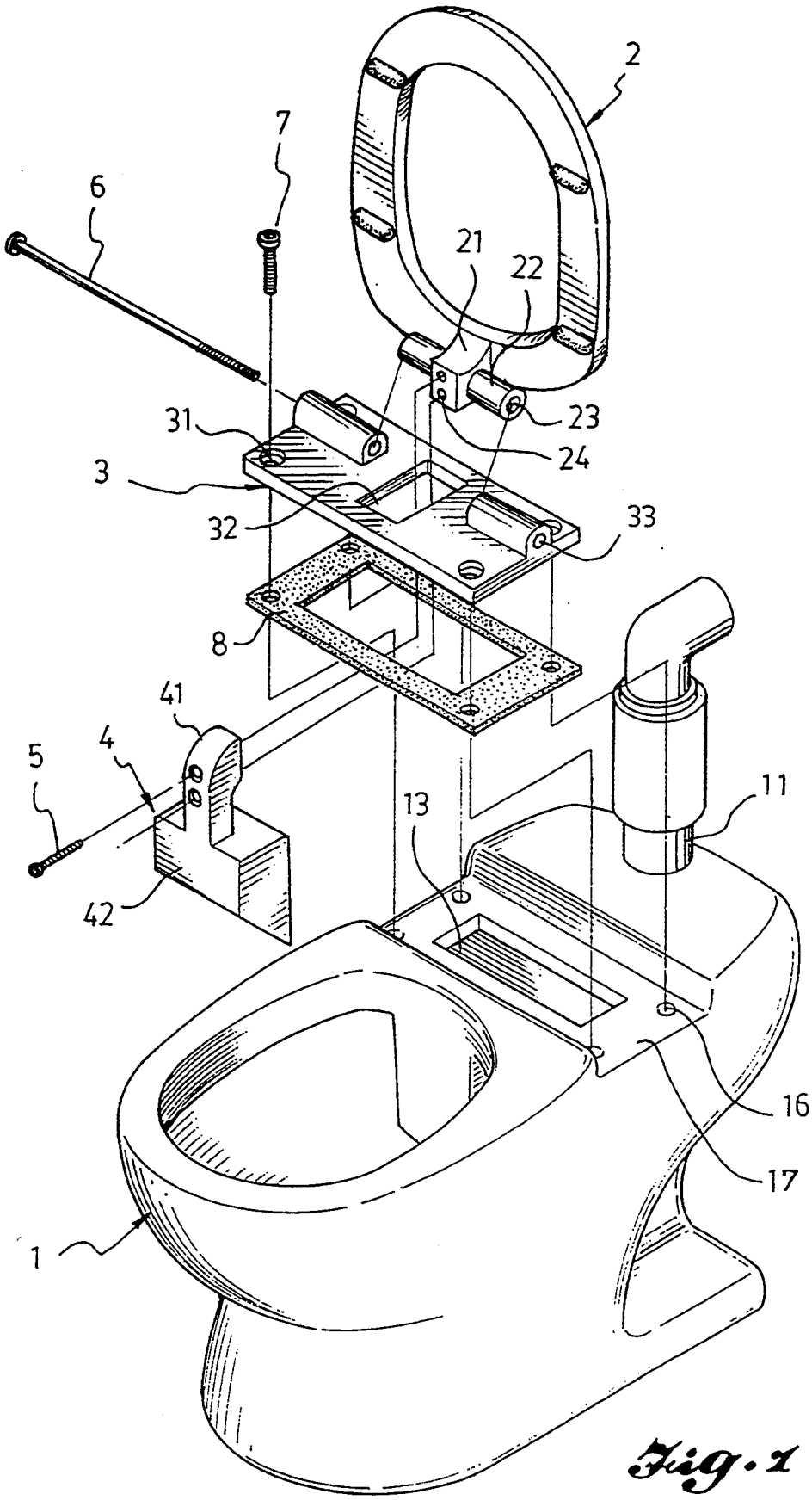
FIG. 1 is a perspectively exploded view showing one preferred embodiment in accordance with the present invention.
Figure 2:
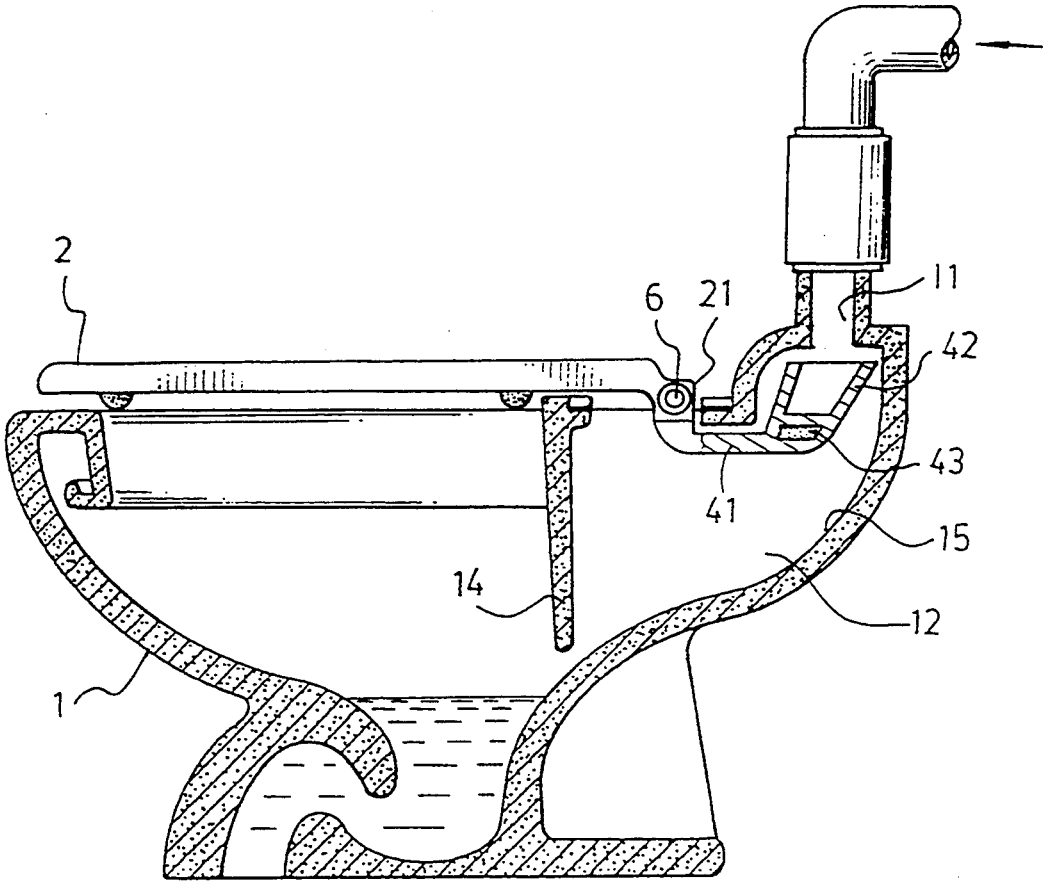
FIG. 2 is a longitudinally cross-sectional view showing one preferred embodiment in accordance with the present invention when the toilet seat is placed on the toilet bowl in a horizontal position.

Referring to FIGS. 1 and 2, a toilet assembly having a hydraulically rising seat disclosed in the present invention mainly comprises a toilet bowl (1), a toilet seat (2), an assembling pad (3) and a scoop (4). The toilet bowl (1) includes a flushing inlet (11), a flushing water passage (12), a positioning base (17) and a water distributing baffle (14). The flushing water inlet (11) upwardly extends from the toilet bowl (1). The flushing water passage (12) is provided within the toilet bowl (1) and below the flushing inlet (11) and includes a downwardly inclined and curved bottom surface (15) to be in fluid communication with the flushing inlet (11). A transverse and rectangular through opening (13) is centrally formed at the positioning base (17). The water distributing baffle (14) is provided at one lower end of the flushing water passage (12), so as to transversely distribute flushing water. A plurality of threaded holes (16) is peripherally provided around the through opening (13) for securing the assembling pad (3) onto the positioning base (17).

The toilet seat (2) is substantially in a ring shape and includes a pivot block (21). Two opposite and cylindrical shafts (22) coaxially and transversely extend from the pivot block (21). A through axial hole (23) is formed through both the shaft (22) and the pivot block (21). The pivot block (21) further comprises at least two threaded holes (24).

The assembling pad (3) is substantially in flat plate shape, and includes a plurality of through holes (31) corresponding to the threaded holes (16) of the positioning base (1). An elongated through hole (32) is centrally formed on the assembling pad (3). Two axial holes (33) is coaxially and transversely formed at lateral sides of the pad (3) to allow an elongated bolt (6) passing through the axial holes (23) and (33) for pivotally assembling the seat (2) onto the pad (3).

As can be seen in FIGS. 1 and 2, the scoop (4) comprises a scoop handle (41) and a cup (42). The cup (42) is in a wide and shallow dish shape for receiving water therein. The scoop handle (41) laterally extends from the cup (42) and is adapted to pass through the through hole (32) of the assembling pad (3) and firmly connects with the pivot block (21) by attaching a plurality of bolts (5) into the thread holes (24).

Referring to FIGS. 1 and 2, when in assembling, the scoop handle (41) can pass through the through hole (32) of the assembling pad (3) to firmly connect with the pivot block (21) of the seat (2). The elongated bolt (6) passes through the axial holes (23) and (33) to pivotally assemble the seat (2) to the assembling pad (3). The assembling pad (3) then is secured onto the toilet bowl (1) by attaching a plurality bolts (7) through holes (31) and into holes (16).

Figure 4:
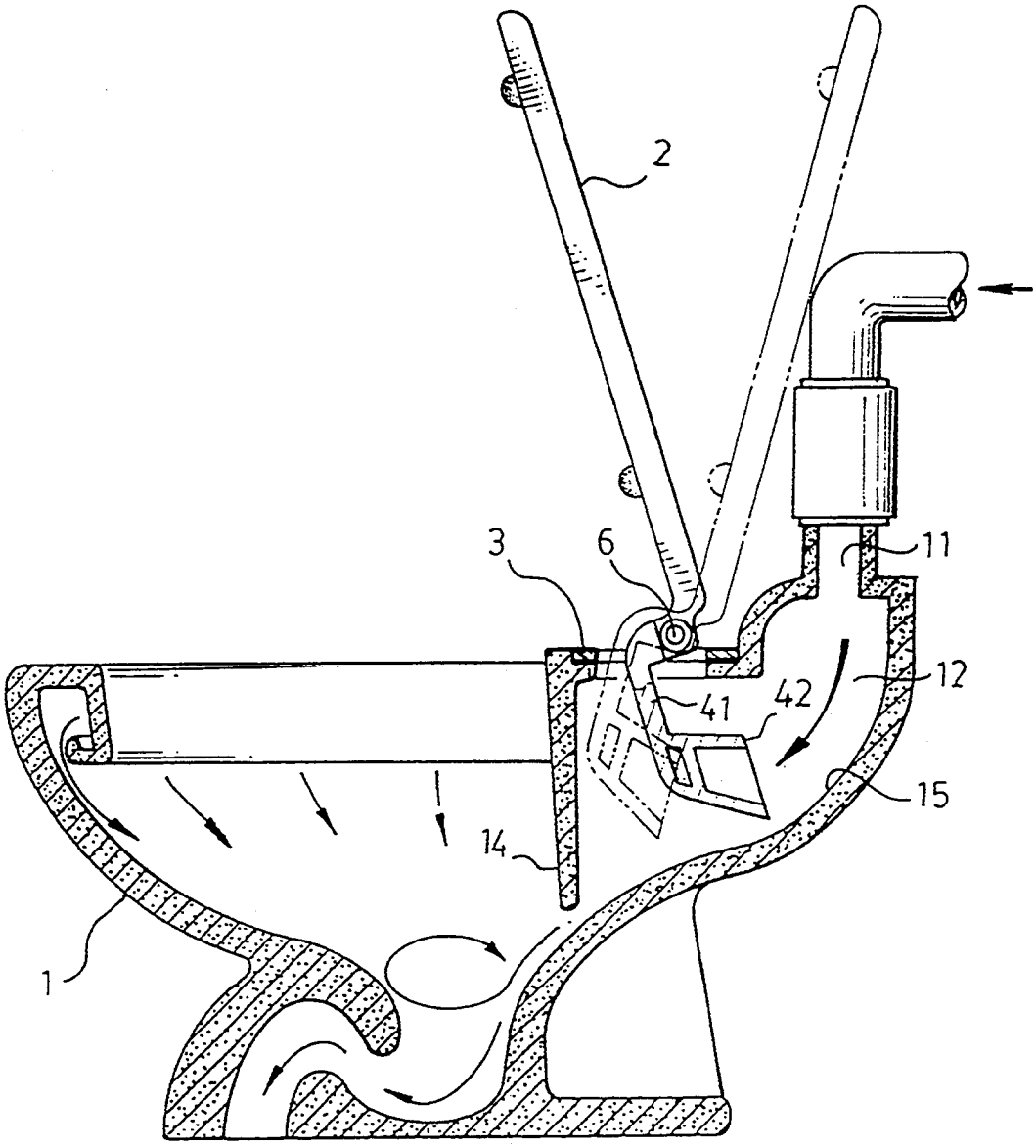
FIG. 4 is still another longitudinally cross-sectional view showing the toilet seat being hydraulically raised by weight and flow of flushing water.

As can be seen in FIG. 2, when the toilet seat is in a horizontal position, the cup (42) of the scoop (4) is located below the flushing inlet (11). Referring to FIG. 4, when the toilet seat (2) is lifted, the cup of the scoop (4) moves along a path in compliance with the profile of the bottom surface (15) of the flushing water passage (12).

With reference to FIGS. 2 and 4, when the toilet is in a flushing operation, flushing water from the flushing inlet (11) rapidly and downwardly flows to push the cup (42) of the scoop (4), so as to create a rotational torque for rising the seat (2). In addition, when the toilet seat (2) is in a horizontal position, the weight of the amount of water received in the cup (42) in association with the scoop handle (41) also creates a rotational torque for rising the toilet seat (2). The toilet seat (2) therefore can be automatically raised by the torque created by the kinetic energy and weight of the flushing water to be in a vertical position as shown in FIG. 3.

Figure 3:
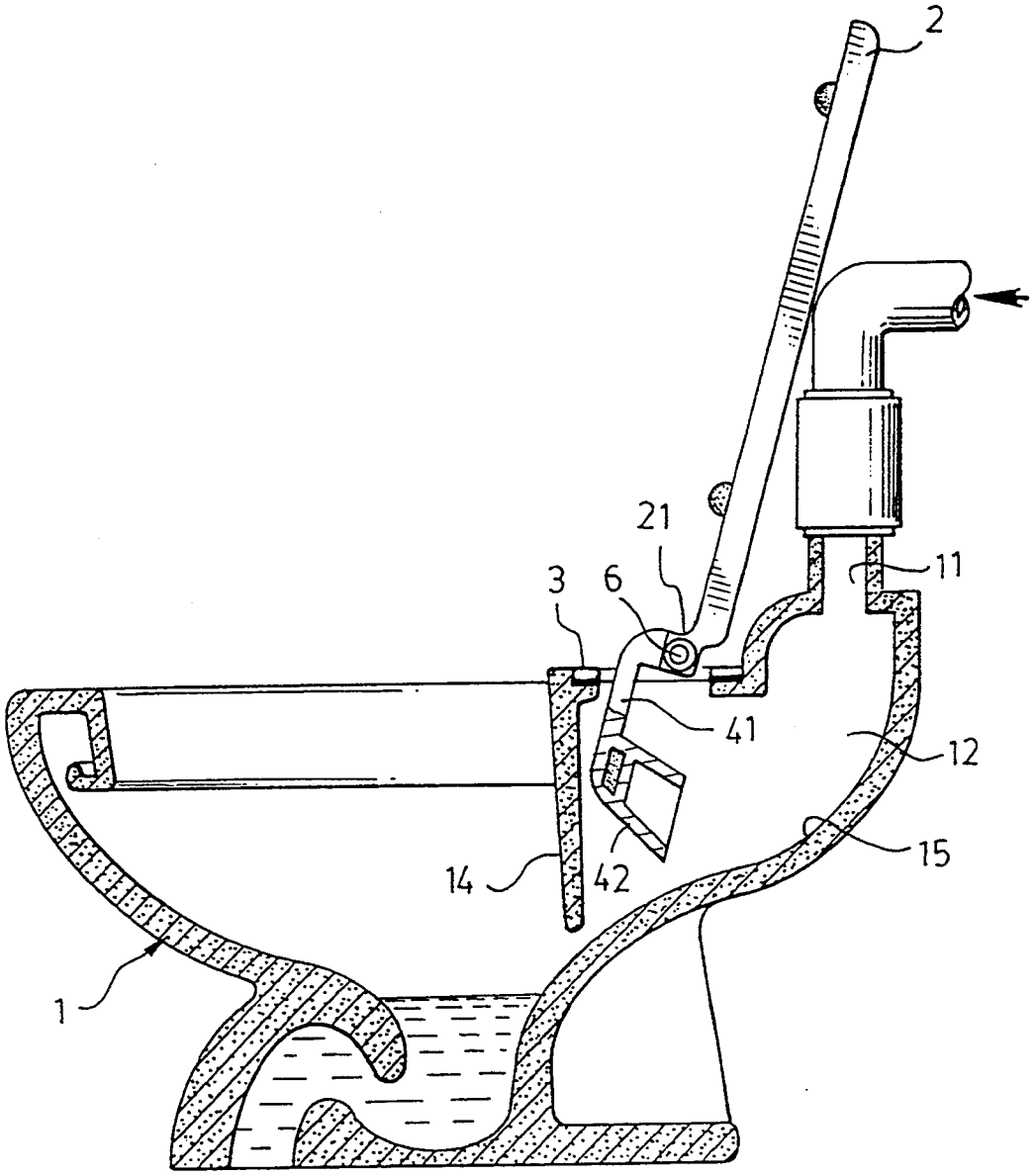
FIG. 3 is another longitudinally cross-sectional view showing that the toilet seat is in a vertical position.

Referring to FIGS. 3 and 4, when the toilet seat was raised to the vertical position (see FIG. 3), water received in the cup (42) flows out of the cup (42) by gravity to facilitate the next operation for lying the toilet seat (2) onto the toilet bowl (1) as shown in FIG. 2.

In designing, dead weight of the scoop (4) and the capacity of the cup (42) can be made in response to the torque created by the weight of the seat (2), so that the balance condition between the scoop (4) and the seat (2) be adjusted to be substantially the same to each other, and so that the flowing of flushing water impinging onto the scoop (4) can create a torque to easily lift the seat (2). For example, the scoop (4) may further comprise a balance weight chamber (43) for containing high density material, e.g., lead, iron or the like, so that the balance condition between the seat (2) and the scoop (4) can be appropriately adjusted. The flushing inlet (11) may connect to a water closet or some other water supplying system.

The preferred embodiment of the present invention has been described in detail, but it will be understood that variations and modification can be effected within the spirit and scope of the invention.

I claim:

1. A toilet assembly having a hydraulically lifted seat comprising:

a toilet bowl having a waste receiving space, a flushing water inlet, a flushing water passage, and a base for supporting said bowl on a floor, said bowl further having a transverse opening located in a rear portion thereof between said flushing water inlet and said waste receiving space, an upper perimeter surface of said transverse opening defining a positioning base;

a toilet seat having pivoting means at a rear portion thereof;

an assembling pad having a transverse opening therethrough, said pad being attached to and positioned on said positioning base such that said transverse opening in said pad overlies, and is aligned with, said transverse opening in said bowl, said pad further having pivoting means for mating with said pivoting means on said seat such that said seat is pivotally attached to said pad;

a scoop including a cup portion, said scoop adapted to be located in said bowl beneath said flushing water inlet, said cup portion opening upwardly such that water from said inlet fills said cup;

a handle extending through said transverse openings in said bowl and said pad and connecting said toilet seat to said scoop;

said flushing water passage having a smooth and curved bottom surface, said scoop being adapted to move along a path defined by said bottom surface of said water passage with a predetermined clearance between said scoop and said bottom surface; whereby, when said toilet is flushed, water from said flushing water inlet fills said cup portion of said scoop, causing said scoop to travel along said path defined by said bottom surface and pivot said seat from a horizontal to a vertical position.

2. A toilet assembly according to claim 1 wherein said scoop further comprises a balance weight chamber in which high density material can be contained to offset a portion of the weight of said toilet seat.

* * * * *